US010212504B2

(12) United States Patent
Ide et al.

(10) Patent No.: US 10,212,504 B2
(45) **Date of Patent: *Feb. 19, 2019**

(54) EARPHONE DEVICE

(71) Applicant: Sony Corporation, Tokyo (JP)

(72) Inventors: Kenji Ide, Chiba (JP); Kazuhisa Kito, Kanagawa (JP); Naotaka Tsunoda, Tokyo (JP)

(73) Assignee: Sony Corporation, Tokyo (JP)

( * ) Notice: Subject to any disclaimer, the term of this patent is extended or adjusted under 35 U.S.C. 154(b) by 1 day.

This patent is subject to a terminal disclaimer.

(21) Appl. No.: 15/255,733

(22) Filed: Sep. 2, 2016

(65) Prior Publication Data

US 2016/0373853 A1 Dec. 22, 2016

Related U.S. Application Data

(63) Continuation of application No. 13/565,160, filed on Aug. 2, 2012, now Pat. No. 9,451,350.

(30) Foreign Application Priority Data

Aug. 31, 2011 (JP) ..... 2011-189554

(51) Int. Cl.
*H04R 1/10* (2006.01)
*H04R 5/04* (2006.01)

(52) U.S. Cl.
CPC ..... *H04R 1/1016* (2013.01); *H04R 1/1025* (2013.01); *H04R 1/1041* (2013.01);
(Continued)

(58) Field of Classification Search
CPC ..... H04R 5/04; H04R 1/1075; H04R 1/1083; H04R 1/1033; H04R 2201/107; H04R 1/1025; H04R 2201/003
(Continued)

(56) References Cited

U.S. PATENT DOCUMENTS 5,448,646 A 9/1995 Lucey et al.
6,321,278 B1 11/2001 Phu et al.
(Continued)

FOREIGN PATENT DOCUMENTS

CN 1717120 A 1/2006
EP 1 558 059 A2 7/2005
(Continued)

OTHER PUBLICATIONS

Bose Corporation: A20 Aviation Headset Owner's guide. Jul. 26, 2011; XP055241328. https://www.manualowl.com/m/Bose/A20-Aviation/Manual/19921 [retrieved on Jan. 14, 2016].
(Continued)

*Primary Examiner* — Paul S Kim
(74) *Attorney, Agent, or Firm* — Wolf, Greenfield & Sacks, P.C.

(57) ABSTRACT

There is provided an earphone device of an ear-hole insertion type having a noise cancelling function, the earphone device including a left channel housing unit that accommodates a left channel driver unit outputting a left channel sound; and a right channel housing unit that accommodates a right channel driver unit outputting a right channel sound. A microphone for noise cancelling and a battery are accommodated in each of the left and right channel housing units.

8 Claims, 13 Drawing Sheets

NC MODE SIMULTANEOUS CONTROL

(52) U.S. Cl.
CPC ..... *H04R 1/1058* (2013.01); *H04R 1/1075* (2013.01); *H04R 1/1083* (2013.01); *H04R 5/04* (2013.01); *H04R 1/1033* (2013.01); *H04R 2201/003* (2013.01); *H04R 2201/107* (2013.01); *H04R 2460/01* (2013.01)

(58) Field of Classification Search
USPC ..... 381/309, 74, 370, 380, 71.1, 328, 94.1
See application file for complete search history.

(56) References Cited

U.S. PATENT DOCUMENTS

| | | | | |
|---|---|---|---|---|
| 6,396,934 | B1 | 5/2002 | Federspiel | |
| 6,567,524 | B1 | 5/2003 | Svean et al. | |
| 6,839,447 | B2 | 1/2005 | Nielsen et al. | |
| 7,039,195 | B1 | 5/2006 | Svean et al. | |
| 7,215,766 | B2 | 5/2007 | Wurtz | |
| 8,050,439 | B2 | 11/2011 | Inoshita et al. | |
| 8,295,497 | B2 | 10/2012 | Roeck et al. | |
| 8,385,560 | B2 | 2/2013 | Solbeck et al. | |
| 8,498,428 | B2 | 7/2013 | Schreuder et al. | |
| 8,526,659 | B2 | 9/2013 | Nageno et al. | |
| 8,976,987 | B2 | 3/2015 | Ozawa et al. | |
| 9,025,799 | B2 | 5/2015 | Ozawa et al. | |
| 9,451,350 | B2 | 9/2016 | Ide et al. | |
| 9,578,410 | B2 | 2/2017 | Ozawa et al. | |
| 2002/0131613 | A1 | 9/2002 | Jakob | |
| 2003/0014566 | A1 | 1/2003 | Armitage | |
| 2005/0094424 | A1 | 5/2005 | Rivet | |
| 2005/0147269 | A1 | 7/2005 | Oliveira et al. | |
| 2007/0177741 | A1 | 8/2007 | Williamson | |
| 2007/0230734 | A1 | 10/2007 | Beard et al. | |
| 2008/0031481 | A1 | 2/2008 | Warren et al. | |
| 2008/0112569 | A1 | 5/2008 | Asada | |
| 2008/0159568 | A1 | 7/2008 | Asada et al. | |
| 2008/0175402 | A1 | 7/2008 | Abe et al. | |
| 2008/0253583 | A1 | 10/2008 | Goldstein et al. | |
| 2009/0034748 | A1 | 2/2009 | Sibbald | |
| 2009/0046868 | A1* | 2/2009 | Engle | H04R 1/1041 381/74 |
| 2009/0147982 | A1 | 6/2009 | Ashida et al. | |
| 2010/0166205 | A1 | 7/2010 | Yamaoka et al. | |
| 2010/0166207 | A1 | 7/2010 | Masuyama et al. | |
| 2010/0226505 | A1 | 9/2010 | Kimura | |
| 2010/0260362 | A1 | 10/2010 | Sander et al. | |
| 2011/0033073 | A1 | 2/2011 | Inoshita et al. | |
| 2011/0038496 | A1* | 2/2011 | Lott | H04R 5/033 381/309 |
| 2012/0033824 | A1 | 2/2012 | Sim et al. | |
| 2012/0087510 | A1 | 4/2012 | Sampimon et al. | |
| 2012/0087533 | A1 | 4/2012 | Nageno et al. | |
| 2012/0163614 | A1 | 6/2012 | Asada et al. | |
| 2012/0230510 | A1* | 9/2012 | Dinescu | H04R 5/033 381/80 |
| 2013/0051561 | A1 | 2/2013 | Ozawa et al. | |
| 2013/0051562 | A1 | 2/2013 | Ozawa et al. | |
| 2013/0051589 | A1 | 2/2013 | Ide et al. | |
| 2014/0307884 | A1 | 10/2014 | Asada et al. | |
| 2014/0321688 | A1 | 10/2014 | Asada et al. | |
| 2015/0222979 | A1 | 8/2015 | Ozawa et al. | |

FOREIGN PATENT DOCUMENTS

| | | | |
|---|---|---|---|
| EP | 1 608 202 | A2 | 12/2005 |
| JP | 08-079873 | A | 3/1996 |
| JP | H09-9382 | A | 1/1997 |
| JP | 2000-054219 | A | 2/2000 |
| JP | 2000-261534 | A | 9/2000 |
| JP | 2002-112383 | A | 4/2002 |
| JP | 2003-047083 | A | 2/2003 |
| JP | 2003-264883 | A | 9/2003 |
| JP | 2006-324917 | A1 | 11/2006 |
| JP | 2008-122729 | A | 5/2008 |
| JP | 2008-197438 | A | 8/2008 |
| JP | 2009-141698 | A | 6/2009 |
| JP | 4352932 | B2 | 10/2009 |
| JP | 2009-258268 | A | 11/2009 |
| JP | 2010-200260 | A | 9/2010 |
| JP | 2010-213099 | A | 9/2010 |
| JP | 2011-010269 | A | 1/2011 |
| JP | 2012-529212 | A | 11/2012 |
| JP | 2013-504937 | A | 2/2013 |
| WO | WO 2007/140403 | A2 | 12/2007 |
| WO | WO 2008/085863 | A2 | 7/2008 |
| WO | WO 2010/140087 | A1 | 12/2010 |
| WO | WO 2011/031910 | A1 | 3/2011 |
| WO | WO 2011/045905 | A1 | 4/2011 |
| WO | WO 2011/061483 | A2 | 5/2011 |

OTHER PUBLICATIONS

Chinese Office Action dated Oct. 19, 2016 in connection with Chinese Application No. 201210308158.6, and English translation thereof.

Japanese Office Action dated Aug. 29, 2017 in connection with Japanese Application No. 2016-193351, and English translation thereof.

* cited by examiner

A

B

NC MODE SIMULTANEOUS CONTROL

ERROR DETECTION CONTROL

SIMULTANEOUS LR OFF CONTROL

REMAINING LEVEL DISPLAY CONTROL

EARPHONE DEVICE

CROSS REFERENCE TO RELATED APPLICATIONS

This application is a continuation of and claims the benefit under 37 U.S.C. § 120 of U.S. patent application Ser. No. 13/565,160, titled "EARPHONE DEVICE," filed Aug. 2, 2012, which claims the benefit of Japanese Priority Patent Application JP2011-189554 filed Aug. 31, 2011.

BACKGROUND

The present disclosure relates to a to an ear-hole insertion type earphone device having a noise cancelling function.

Earphone devices with a noise cancelling function (hereinafter, also referred to as NC earphone devices) have come into wide use. Because an NC earphone device performs noise cancelling processing by itself, users may enjoy a noise cancelling effect even when the NC earphone device is connected to a normal audio player.

FIG. 13 is a diagram showing an appearance of the NC earphone device 100 according to related art. The NC earphone device 100 shown in FIG. 13 is a so-called ear-hole insertion type of earphone device. Here, the ear-hole insertion type of earphone device includes any earphone device of which sound output units are inserted into user's ear-holes so that the users may hear. For example, the ear-hole insertion type of earphone device is an in-ear type of earphone device or a canal type of earphone device. The NC earphone device 100 shown in FIG. 13 is the canal type of NC earphone device.

As illustrated in FIG. 13, the NC device earphone 100 has a left channel (Lch) output unit 101L, a right channel (Rch) output unit 101R, a plug unit 102, and a cord housing unit 103. A cord connects the plug unit 102 to the cord housing unit 103, and each cord connects the Lch output unit 101L and the Rch output unit 101R to the cord housing unit 103, as illustrated in FIG. 13.

A driver unit outputting sounds corresponding to sound signals input from the plug unit 102 and a microphone recording external sounds for the realization of the noise cancelling function are installed in the Lch output unit 101L and the Rch output unit 101R, respectively.

An electric circuit unit (a noise cancelling processing unit) to provide the noise cancelling function is installed inside of the cord housing unit 103. The noise cancelling processing unit generates a noise cancelling signal of the left channel based on a Lch sound signal input from the plug unit 102 and a sound signal recorded from the microphone of the Lch output unit 101L and a noise cancelling signal of the right channel based on a Rch sound signal input from the plug unit 102 and a sound signal recorded from the microphone of the Rch output unit 101R. When the noise cancelling processing unit drives the driver unit of the Lch output unit 101L according to the noise cancelling signal of the left channel and the driver unit of the Rch output unit 101R according to the noise cancelling signal of the right channel, users wearing the NC earphone device 100 may hear noise-cancelled sounds.

SUMMARY

Here, the NC earphone device requests to supply the power of its own that is used for the noise cancelling processing, in order to be suitable for an usual audio player, for example, having output terminals of Lch, Rch, and GND.

In the NC earphone device 100 in related art, the battery case 103A accommodating a battery for the power supply is formed in the cord housing unit 103, as illustrated in FIG. 13.

However, when the battery case 103A is formed in the cord housing unit 103, as such an extent, the cord housing unit 103 becomes enlarged. For example, the size of the battery case 103A is considerably large because the NC earphone device 100 in related art is considered to use a single AA-sized first battery or a single AAA-sized first battery.

In addition, when the battery case 103A is provided, the weight of the cord housing unit 103 increases due to the accommodating of the battery, and accordingly, the feeling of wearing may be impaired because the Lch output unit 101L and the Rch output unit 101R are pulled down. In addition, in order to solve the problem in the past, providing a clip fixing the cord housing unit 103 in appropriate positions such as an edge of the breast pocket, the tension from the cord housing unit 103 due to the weight of the Lch and Rch output units 101L and 101R may be prevented such that the stability of the feeling of wearing may be improved. There are, however, problems that the clip is added to an earphone set and users are forced to effort to use the clip for the prevention of the tension.

Accordingly, in order to solve the problems described above, this technology may be configured as the following ear hole insertion type earphone device having a noise cancelling function. The ear hole insertion type earphone device of this technology has a left channel housing unit accommodating a left channel driver unit outputting a left channel sound and a right channel housing unit accommodating a right channel driver unit outputting a right channel sound, and a microphone for the noise cancelling and a battery are accommodated in each of the left and right channel housing units.

According to an embodiment of the earphone device, the batteries to achieve the noise cancelling function are accommodated in the housings of the Lch and the Rch, so that the battery case disposed in the cord housing unit of the NC earphone device in related art may not be used in the embodiment. Accordingly, the cord housing unit is made significantly small and light, so that it may be prevented that the feeling of wearing of the Lch and Rch output units or sound output units is impaired by the weight of the cord housing unit. In addition, an embodiment of the earphone device, since the Lch and Rch output units are symmetrical bilaterally, the earphone device that weights of the left and right are balanced well and the feeling of wearing is excellent may be achieved. In addition, when the Lch and Rch output units are symmetrical bilaterally, empty spaces in the housings of the Lch and the Rch are the same as each other, so that acoustic characteristics of the Lch and the Rch are the same as each other, thereby achieving the natural feeling of hearing. In addition, as the configuration that the batteries are not accommodated in the cord housing unit, both batteries may be disposed in one housing of both output units, but by this configuration, the housings of the Lch and the Rch are designed separately. However, when the Lch and Rch output units are symmetrical bilaterally, the ease of design may significantly increase because one output unit may be designed by reversing the design of the other output unit regarding the design of the Lch and Rch output units. JP 2003-47083 is a related art describing that a battery is accommodated in a housing of an earphone device.

According to the technology described above, a battery case may be omitted from a cord housing unit such that the earphone device with the excellent feeling of wearing may be achieved. According to the technology, since the Lch and Rch output units are symmetrical bilaterally, the earphone device that weights of the left and right are balanced well and the feeling of wearing is excellent may be achieved. In addition, when the Lch and Rch output units are symmetrical bilaterally, acoustic characteristics of the Lch and the Rch are the same as each other, thereby achieving the natural feeling of hearing.

DETAILED DESCRIPTION OF THE EMBODIMENTS

Figure 1:
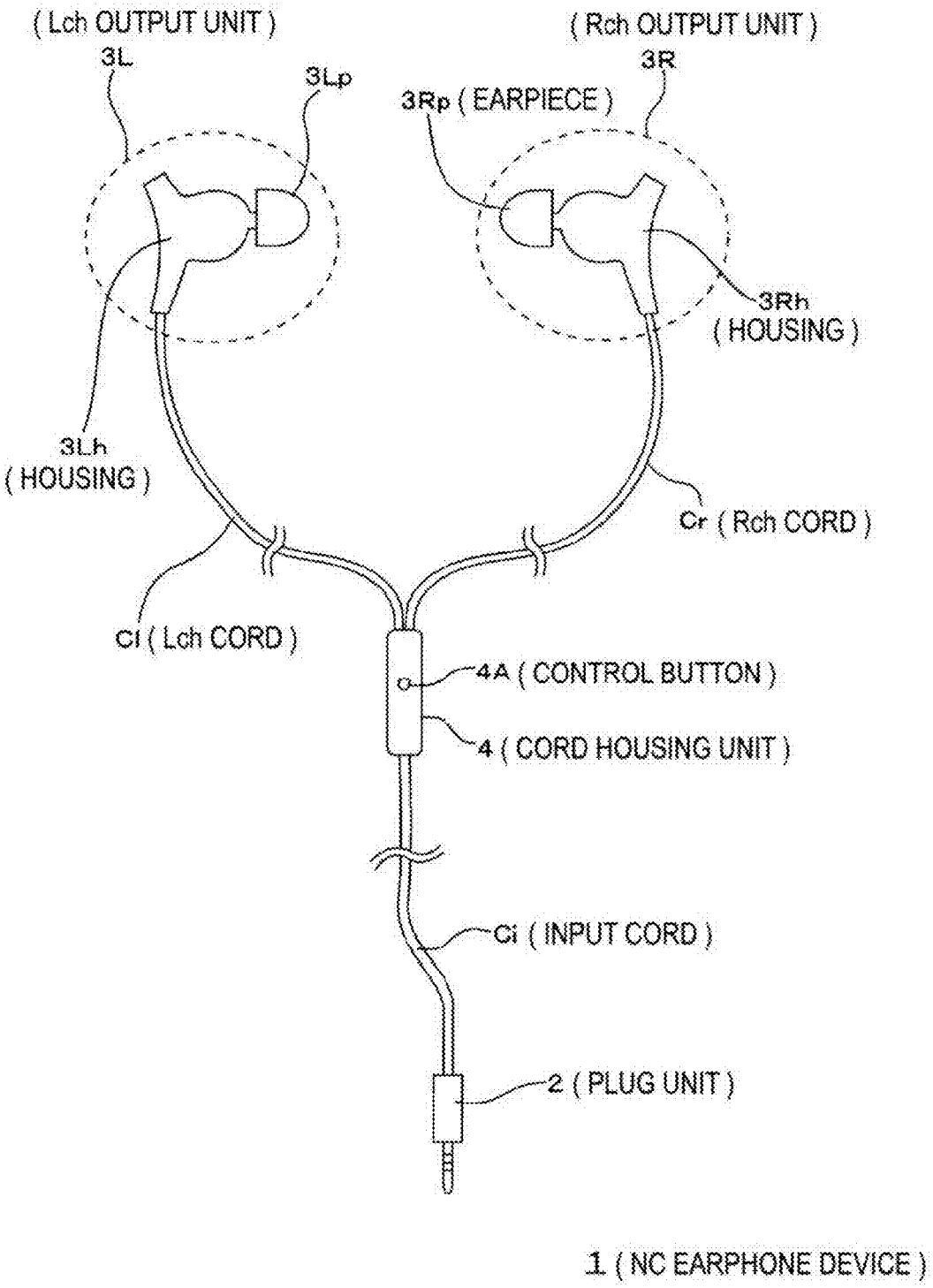
FIG. 1 is an appearance diagram of the NC earphone device according to an embodiment.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that the description will be made in the following order:

1. Device structure according to the embodiment;
2. Device internal configuration according to the embodiment;
3. Communication with external devices;
4. Various functions;
5. Processing procedures;
6 Summary; and
7. Modified Examples.

1. Device Structure According to the Embodiment

FIG. 1 is an appearance view of the noise cancelling (NC) earphone device according to an embodiment of the technology.

Here, the NC earphone device is referred an earphone device with a noise cancelling function. Because the NC earphone device performs to process the noise cancelling by itself, the user may enjoy a noise cancelling effect even when the NC earphone device is connected to a normal audio player.

The NC earphone device 1 is so-called an ear-hole insertion type of earphone device. Here, the ear-hole insertion type of earphone device includes any earphone device of which sound output units are inserted into user's ear-holes so that the users may hear. For example, the ear-hole insertion type of earphone device is an in-ear type of earphone device or a canal type of earphone device. The NC earphone device 1 shown in FIG. 1 is the canal type of NC earphone device.

As illustrated in FIG. 1, the NC earphone device 1 includes a plug unit 2, a left channel (Lch) output unit 3L, a right channel (Rch) output unit 3R, and a cord housing unit 4. In addition, the NC earphone device 1 includes an input cord Ci connecting the plug unit 2 to the cord housing unit 4, a left channel cord Cl connecting the Lch output unit 3L to the cord housing unit 4, and a right channel cord Cr connecting the Rch output unit 3R to the cord housing unit 4, as illustrated in FIG. 1.

The plug unit 2 is provided to enter sound signals output from an audio player which is connected to the NC earphone 1. In the embodiment, the plug unit 2 includes three terminals of a left channel (Lch), a right channel (Rch), and a ground (GND), and the input cord Ci includes three wires corresponding to each terminal of the Lch, the Rch, and the GND.

The Lch output unit 3L outputs sounds based on a left channel sound signal input from the plug unit 2, and the Rch output unit 3R outputs sounds based on a right channel sound signal input from the plug unit 2. The Lch output unit 3L includes a housing 3Lh as a case and an earpiece 3Lp detachably mounted to the housing 3Lh. In similar, the Rch output unit 3R includes a housing 3Rh as a case and an earpiece 3Rp detachably mounted to the housing 3Rh. The earpiece 3Lp of the Lch output unit 3L and the earpiece 3Rp of the Rch output unit 3R are inserted to a corresponding ear-hole, respectively, such that output sounds may be heard.

Here, in order to realize a noise cancelling function, it is provided to record an external sound (external noise). The Lch output unit 3L and the Rch output unit 3R, therefore, include microphones 11*l* and 11*r* recording the external sound, respectively.

The cord housing unit 4 includes an operation unit enabling an on/off operation of the noise cancelling function, in other words a power on/off operation of the NC earphone device 1. In particular, a control button 4A is installed in the cord housing unit 4, as illustrated in FIG. 1, and users may perform the on/off operation of the NC earphone device 1 by the control button 4A. For example, the on/off operation may be achieved by pressing the control button 4A. Pressing the control button 4A in the off-state performs the on operation, and pressing the control button 4A in the on-state performs the off operation.

In an embodiment, wires are branched to the left channel and the right channel in the cord housing unit 4. In particular, the Lch, Rch, and GND wires of the input cord Ci are divided to a pair of Lch and GND and a pair of Rch and GND inside of the cord housing unit 4, and the pair of Lch and GND reaches the Lch output unit 3L through the Lch cord Cl and the pair of Rch and GND reaches the Rch output unit 3R through the Rch cord Cr. The detailed wiring contained in the Lch cord Cl and the Rch cord Cr will be described later.

Figure 2:
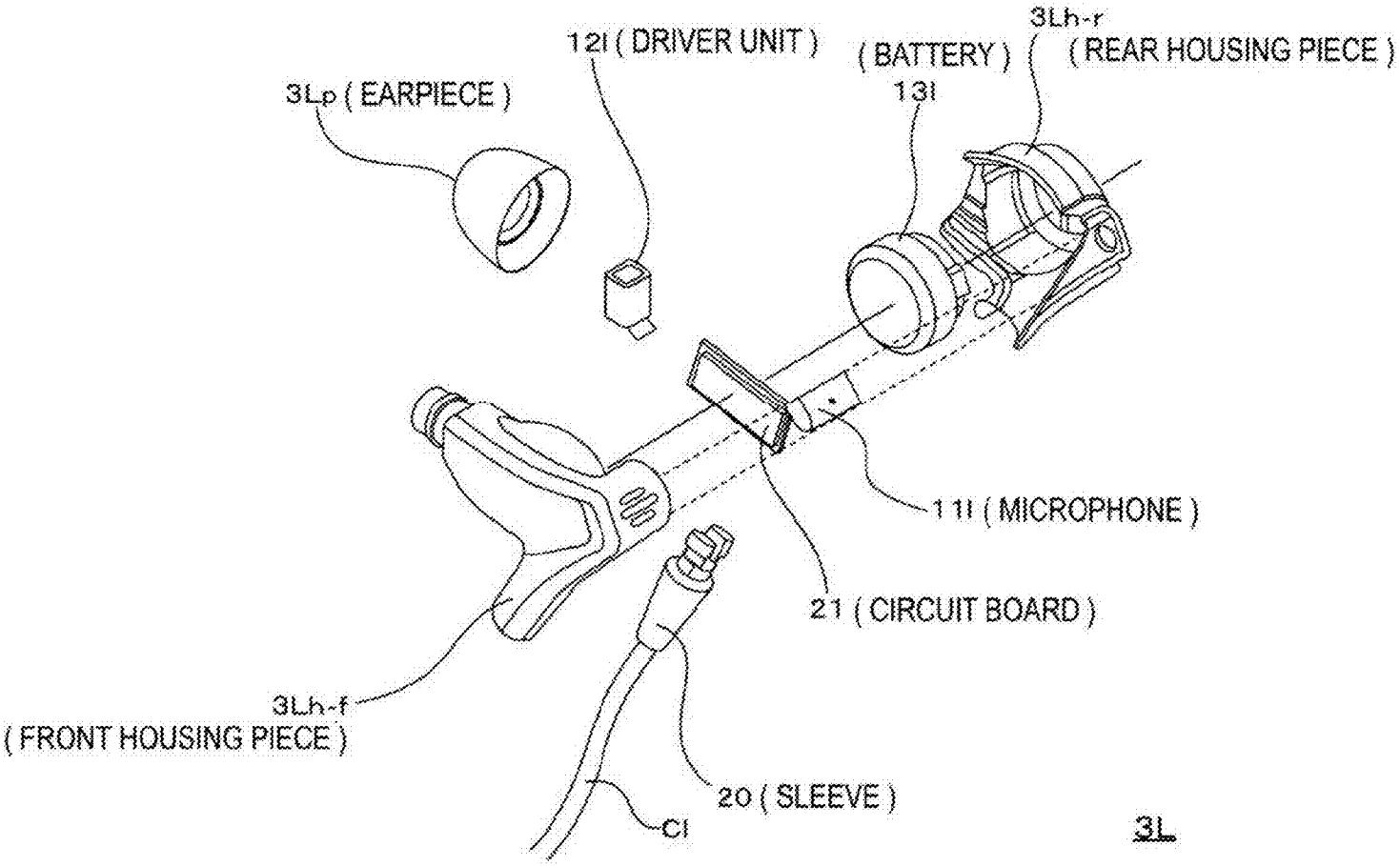
FIG. 2 is an exploded perspective view of the Lch output unit according to an embodiment.
Figure 3:
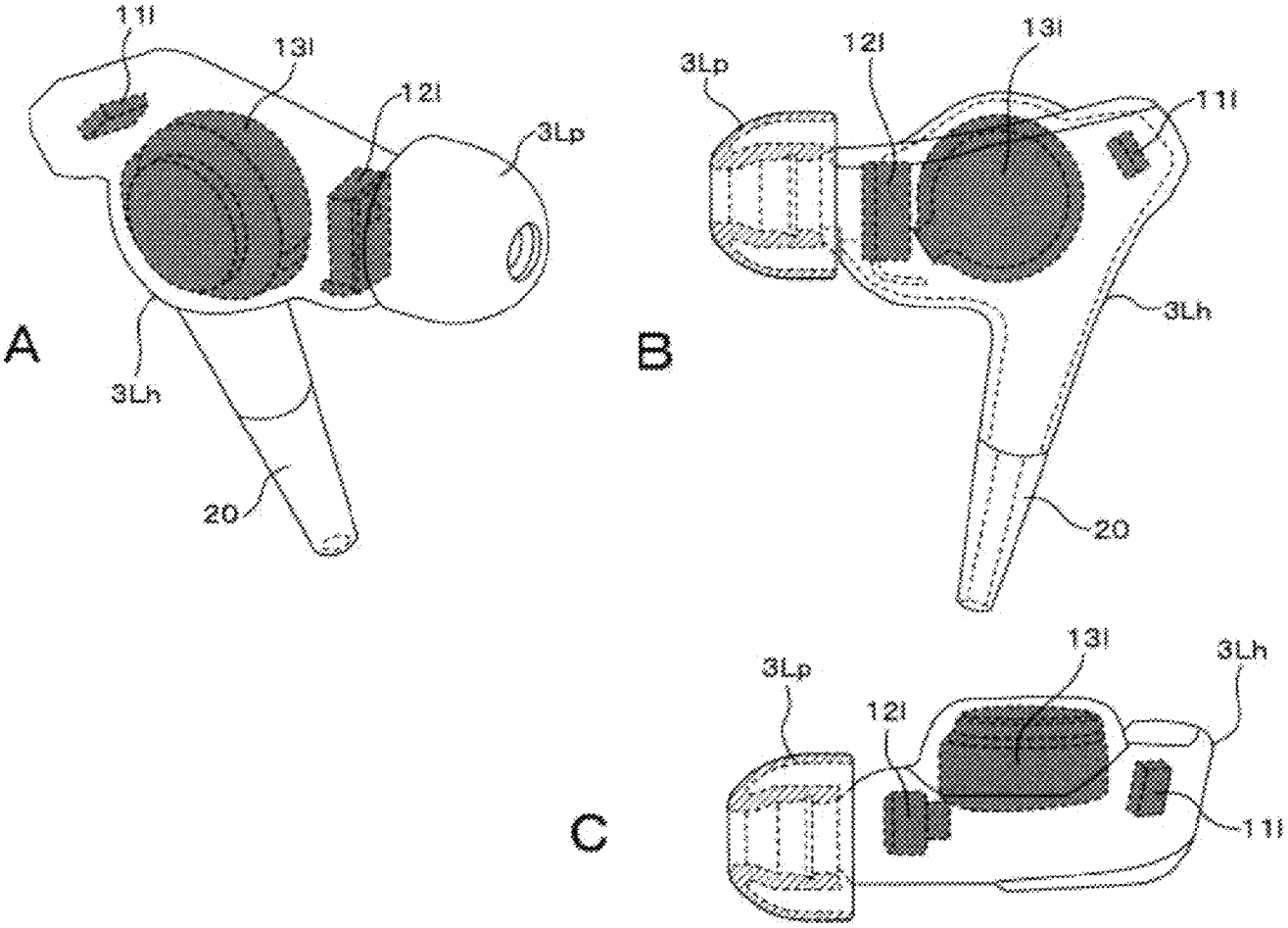
FIGS. 3A, 3B and 3C are drawings illustrating a position relationship of the microphone, the driver unit, and the battery accommodated in the housing.
Figure 4:
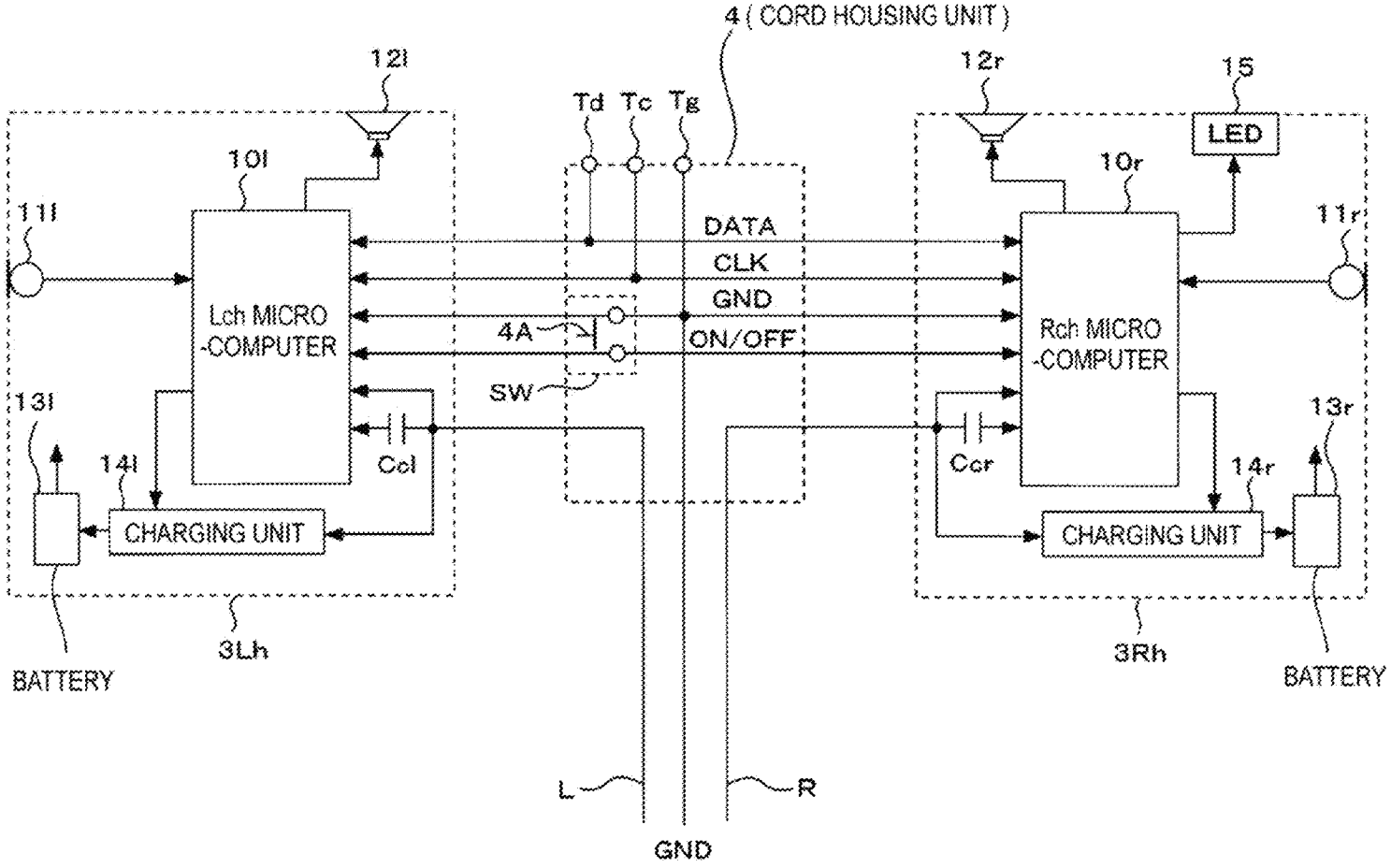
FIG. 4 is a block diagram illustrating internal components of the NC earphone device according to an embodiment.

Next, FIGS. 2 and 3 describe a housing of the Lch output unit 3L and the Rch output unit 3R according to the embodiment. FIG. 2 shows an exploded perspective view of the Lch output unit 3L. Here, descriptions about the housing of the Rch output unit 3R is omitted because the Rch output unit 3R is a left and right reverse form of the Lch output unit 3L with an exception that an LED 15 is provided to the Rch output unit 3R as illustrated in FIG. 4. In FIG. 2, both the Lch output unit 3L and the Lch cord Cl are shown. In addition, the LED 15 as illustrated in FIG. 4 installed in the Rch output unit 3R is an indicator which represents a remaining amount of the battery and an on/off state of the NC earphone device 1.

The Lch output unit 3L includes a front housing piece 3Lh-f and a rear housing piece 3Rh-r which make up the housing 3Lh shown in FIG. 1, the earpiece 3Lp shown in FIG. 1, and a sleeve 20 guiding the Lch cord Cl in the housing 3Lh.

In addition, in the embodiment, a microphone 11*l*, a driver unit 12*l*, a circuit board 21, and a battery 13*l* are accommodated inside of the housing 3Lh having the front housing piece 3Lh-f and the rear housing piece 3Rh-r.

The microphone 11*l* is provided to record an external sound. Because a canal type of earphone device employs a feed forward (FF) method to cancel noises, a recording surface of the microphone 11*l* is looking to an opposite direction to an output direction of the driver unit 12*l*, in order to record the external sound outside of the housing 3Lh. For example, the microphone 11*l* is a Micro Electro Mechanical Systems (MEMS) microphone.

The circuit board 21 includes an electric circuit to achieve the noise cancelling function and other various functions described below. A left channel micro-computer 10*l* or a right channel micro-computer 10*r* of the Rch output unit 3R is formed on the circuit board 21.

The battery 13*l* is provided as part of operating a power source of the electrical circuit formed on the circuit board 21. In the embodiment, a button-shaped secondary battery may be used.

The driver unit 12*l* outputs or plays sounds based on sound signals. In the embodiment, the driver unit 12*l* may be a type of Balanced Armature (BA).

In the embodiment, a hole of the earpiece 3Lp fits a top tube, having an entrance of the sound emission, of the front housing piece 3Lh-f such that the earpiece 3LP is attached to the housing 3Lh.

FIG. 3 represents a positional relationship between the microphone 11*l*, the driver unit 12*l*, and the battery 13*l* which are accommodated in the housing 3Lh. FIGS. 3A, 3B, and 3C are perspective drawings of the Lch output unit 3L, and a perspective view, a front view, and a top view, respectively.

As illustrated in FIG. 2 and FIG. 3, the housing 3Lh is designed to have an approximately cylindrical space separated from a space in which the driver unit 12*l* is accommodated. The approximately cylindrical space is designed to accommodate the circuit board 21 and the button-shaped battery 13*l*. According to the design of the housing 3Lh, the battery 13*l* and other components are effectively accommodated in the housing 3Lh of the ear-hole insertion type of earphone device requesting that a housing of the sound output unit has a small size.

In the embodiment, the microphone 11*l* may be a MEMS microphone. Because the MEMS microphone is small, the microphone as well as the battery 13*l* and other components are easily accommodated in the housing 3Lh, thereby improving the efficiency of the design, or increasing the degree of freedom in design.

In the embodiment, the driver unit 12*l* is a BA type of the driver unit, and the BA type of the driver unit has a smaller size, compared to other types of the driver unit such as a dynamic type, such that the housing 3Lh accommodating the battery 13*l* and other components may be easily designed, thereby increasing the degree of freedom in design.

Here, according to the NC earphone device 1, since batteries 13 are accommodated to the housings 3Lh and 3Rh of the Lch output unit and the Rch output unit, the NC earphone device 1 is not used to have the battery box 103A of the cord housing unit 103 in the NC earphone device 100 in related art. Accordingly, the cord housing unit 4 in the present NC earphone device 1 may be significantly small and light so that the weight of the cord housing unit 4 may reduce the deterioration of the feeling of wearing of the Lch and Rch sound output units and the like.

In addition, the NC earphone device 1 according to the embodiment includes the Lch sound output unit and the Rch sound output unit which are symmetrical bilaterally except the LED 15. As a result, the earphone device that the left and right weights of the earphone device are balanced well and the feeling of wearing is excellent may be made.

In addition, when the Lch and Rch output units are symmetrical bilaterally, empty spaces in the housings of the Lch and the Rch are the same as each other, so that acoustic characteristics of the Lch and the Rch are the same as each other, thereby achieving the natural feeling of hearing.

Because the LED 15 is very compact and light, the difference between acoustic properties based on whether the weight of the LED 15 is added or not is negligent.

In addition, when the battery 13 is accommodated in any one of the Lch and Rch housings as the design that the battery 13 is disposed in another position than the cord housing unit 4, the Lch and Rch housings are independently designed. In contrast, according to the embodiment with a symmetrical structure, with respect to designs of the Lch and Rch sound output units, any one of the Lch and Rch sound output units is designed reversely when the other of the Lch and Rch sound output units is designed, thereby designing easily.

In addition, when batteries are disposed in both sides of the Lch and Rch sound output units other than a single battery design, the sizes of the Lch and Rch sound output units may be equal to each other.

2. Device Internal Configuration According to the Embodiment

FIG. 4 is a block diagram illustrating internal components of the NC earphone device according to an embodiment. Terminals Lch, Rch, and GND formed in the plug unit 2 are omitted in FIG. 4.

First, a left channel (Lch) signal and a right channel (Rch) signal input via the plug unit 2 is input inside of the housings 3Lh and 3Rh through the cord housing unit 4. In the housing 3Lh, the Lch signal is supplied to the left channel micro-computer 10*l* and a charging unit 14*l*. In the embodiment, two kinds of signals which are a signal through a capacitor Ccl and a signal not through the capacitor Ccl are input the Lch micro-computer 10*l* as the Lch signal. Similarly, in the housing 3Rh, the Rch signal is supplied to the right channel microcomputer 10*r* and a charging unit 14*r*. In the embodiment, two kinds of signals which are a signal through a capacitor Ccr and a signal not through the capacitor Ccr are input the Rch micro-computer 10*r* as the Rch signal. The capacitor Ccl and Ccr are provided for the cut of the DC component. The Lch signal through the capacitor Ccl and the Rch signal through the capacitor Ccr may be used to process the noise cancelling by the microcomputers 10*l* and 10*r*, respectively, or to process to drive the driver units 12*l* and 12*r*, respectively, when the noise cancelling function is turned off.

Here, in the embodiment, signals not through the capacitors Ccl and Ccr, which are signals without cutting the DC component, are input to the micro-computers 10*l* and 10*r*, respectively, because it is assumed that batteries 13*l* and 13*r* are charged through Lch and Rch wirings. In this case, when charging, a direct current is supplied through the Lch and Rch wirings, and the micro-computers 10*l* and 10*r* monitor the signals not through the capacitors Ccl and Ccr and determine whether the direct current is supplied or not. When the direct current is supplied, the micro-computers 10*l* and 10*r* instruct the charging units 14*l* and 14*r* to charge the batteries 13*l* and 13*r*, respectively. In this regard, the charging control unit Fn4 will be described later. In addition, as illustrated in FIG. 4, the charging unit 14*l* supplies the direct current through the Lch wiring connected to the charging unit 14*l* to the battery 13*l* and charges the battery 13*l*. In similar, the charging unit 14*r* supplies the direct current through the Rch wiring connected to the charging unit 14*r* to the battery 13*r* and charges the battery 13*r*.

Figure 7:
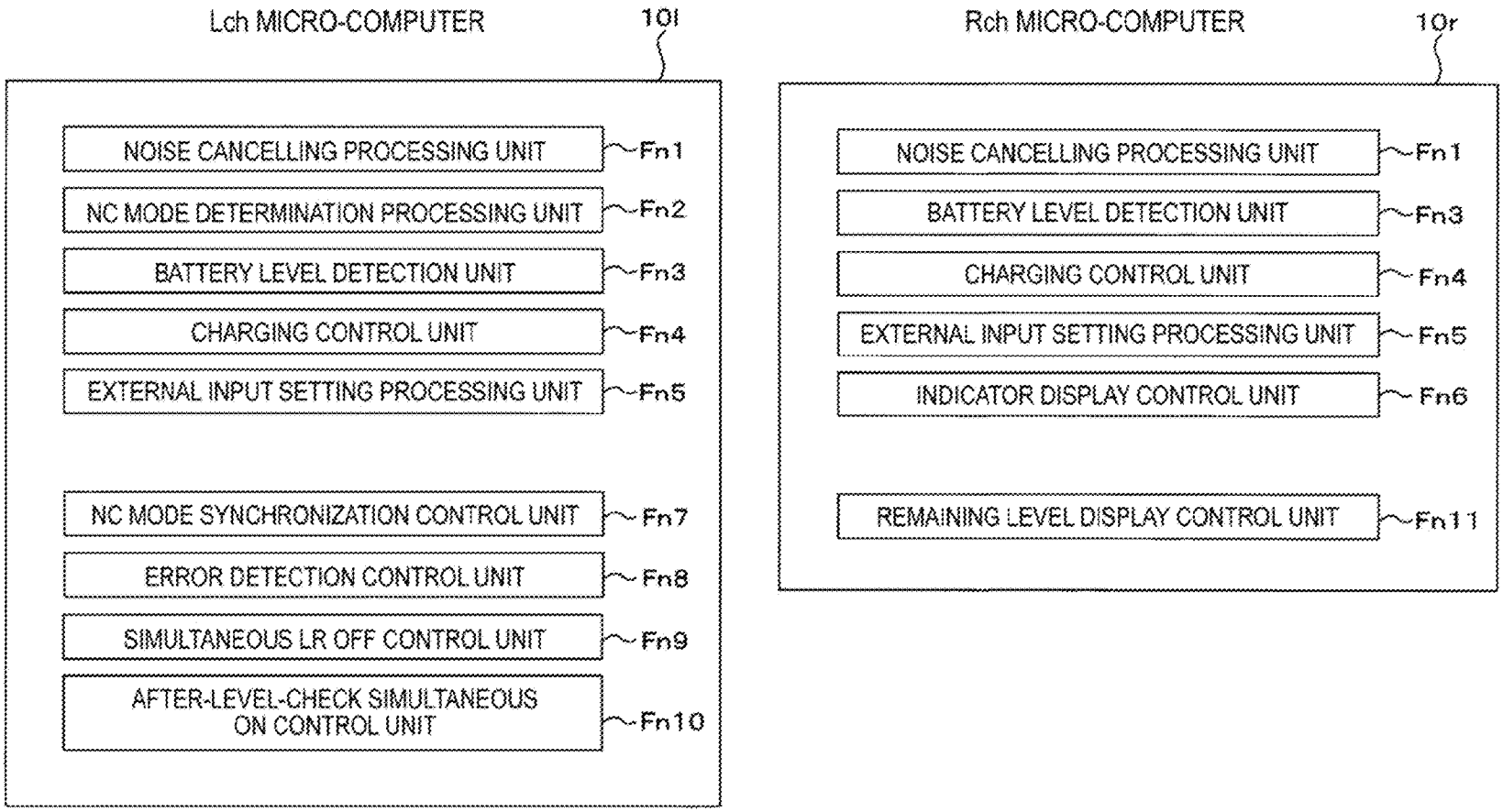
FIG. 7 is a drawing illustrating various functions of the left channel micro-computer and the right channel micro-computer.

The micro-computers 10*l* and 10*r* executes processes by various units Fn, as illustrated in FIG. 7, which will be described later. For example, the noise cancelling function is performed by the noise cancelling processing unit Fn1 which will be described later. Specifically, the Lch micro-computer 10*l* generates a noise cancelling signal to cancel external sounds or noises based on the Lch signal input from the capacitor Ccl and a recording signal from the microphone 11*l*, and drives the driver unit 12*l* based on the noise cancelling signal. Accordingly, a user wearing the NC earphone device 1 may listen to an Lch sound that the external sounds are cancelled. In other words, a noise cancelling effect is obtained. In addition, a noise cancelling processing by the Rch micro-computer 10*r* is described in the same way as the Lch micro-computer 10*l* except the sign of L or R, so that detailed descriptions are omitted.

In the embodiment, the LED 15 is disposed in the housing 3Rh, so that the Rch micro-computer 10*r* controls to drive the emission of the LED 15. In this regard, the indicator display control unit Fn6 will be described later.

In an embodiment, the Lch micro-computer 10*l* and the Rch micro-computer 10*r* are configured to communicate data with each other. For example, the Lch micro-computer 10*l* and the Rch micro-computer 10*r* are configured to communicate data with each other by a wired connection. In this case, as the data communication system, a serial communication method by Inter-Integrated Circuit (I2C) is employed, and the Lch micro-computer 10*l* and the Rch micro-computer 10*r* are connected to each other by wirings of data DATA, a clock CLK, and a ground GND.

As illustrated in the FIG. 4, the wirings of data DATA, the clock CLK, and the ground GND connect the Lch micro-computer 10*l* to the Rch micro-computer 10*r* through the cord housing unit 4. The Lch cord Cl and the Rch cord Cr described above include the wirings of data DATA, the clock CLK, and the ground GND. In addition, in the embodiment, the wiring of the ground is shared with a ground wiring of sound signals.

The cord housing unit 4 includes the control button 4A and a switch SW. The switch SW is configured to inform the micro-computers 10*l* and 10*r* of whether the control button 4A is pressed or not. In particular, an on/off control line ON/OFF extended from the switch SW is connected to the micro-computers 10*l* and 10*r*, and the switch SW is configured to disconnect the on/off control line to the wiring of the ground GND based on whether the control button 4A is pressed or not. In addition, the on/off control line is connected to the Lch micro-computer 10*l* and the Rch micro-computer 10*r* through the Lch cord Cl and the Rch cord Cr, respectively.

3. Communication with External Devices

Here, NC earphone devices are usually configured to adjust setting values for the noise cancelling processing based on an acoustic inspection, in order to absorb differences between NC earphone devices due to a predetermined timing such as a shipment timing of manufacturing.

In an embodiment, the NC earphone device 1 includes a communication terminal to allow setting values to be input from the outside of the NC earphone device 1 in the cord housing unit 4.

Figure 5:
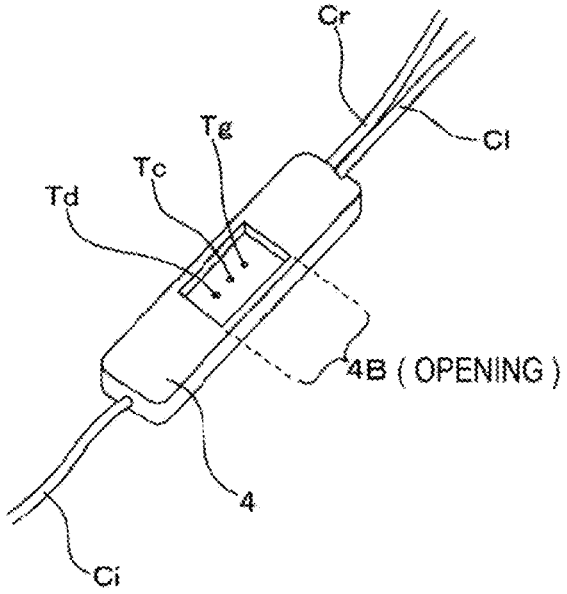
FIGS. 5A and 5B are drawings illustrating a specific embodiment of the communication terminal.
Figure 5:
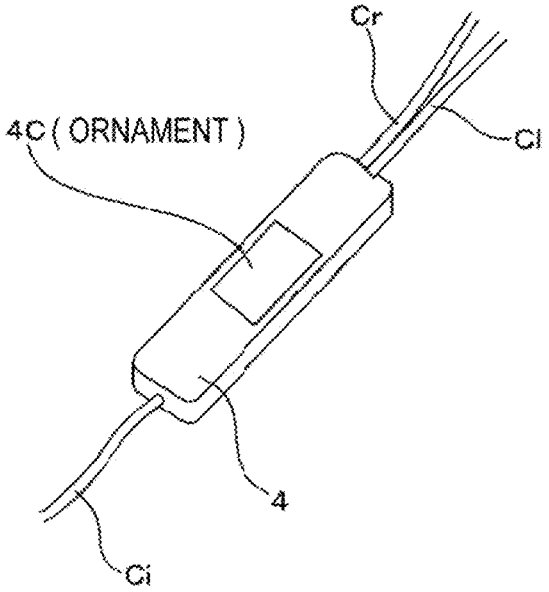

FIG. 5 is a drawing illustrating a specific embodiment of the communication terminal. As shown in FIG. 5A, communication terminals T is exposed on an opposite surface to a surface of the cord housing unit 4 in which the control button 4A is formed. In particular, an opening 4B is formed in the opposite surface of the cord housing unit 4, and the communication terminals T is exposed within the opening 4B. In the embodiment, a data terminal Td, a clock terminal Tc, and a ground terminal Tg as the communication terminals T are formed according to the I2C method as the data communication system of the micro-computers 10*l* and 10*r* described above. As shown in FIG. 4, the data terminal Td, the clock terminal Tc, and the ground terminal Tg are connected to the data line DATA, the clock line CLK, and the ground line GND, respectively.

As illustrated in FIG. 5B, the opening 4B is covered with an ornament 4C before the NC earphone device 1 is shipped. In other words, the communication terminals T are not exposed to the outside when end users purchase the NC earphone device 1.

In the embodiment, the micro-computers 10*l* and 10*r* for the noise cancelling processing are accommodated in the housings of the output unit 3L and 3R, respectively, and the communication terminals T to communicate data between the micro-computers 10*l* and 10*r* are disposed in the cord housing unit 4. As such the configuration, the acoustic inspection is processed under the same condition as actual using when the communication terminals T are exposed in the acoustic inspection, because any part of the output units 3L and 3R is not dissembled. As a result, the setting value for the noise cancelling processing may be adjusted appropriately.

Figure 6:
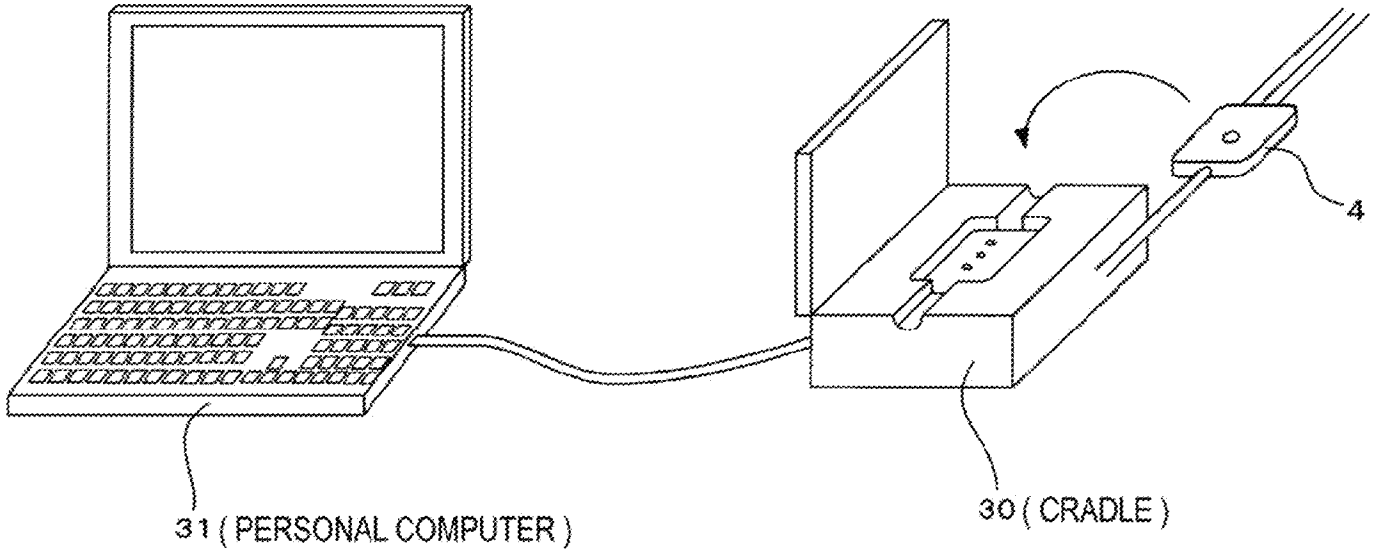
FIG. 6 is a drawing illustrating a specific embodiment of the connection when users make various settings by using the communication terminal.

Here, the settings for the micro-computers 10*l* and 10*r* using the communication terminals T may be adjusted by users as well as at a factory. When users adjust various settings, as illustrated in FIG. 6, a cradle 30 which is exclusively or generally accessible to predetermined information processing devices such as a personal computer 31 may be used. For example, an illustrated in FIG. 6, the cradle 30 includes a fitting portion to fit the cord housing unit 4, and terminals to be connected to the data terminal Td, the clock terminal Tc, and the ground terminal Tg, respectively, are formed in the fitting portion when the cord housing unit 4 is fitted.

Users may operate the personal computer 31 connected to the cradle 30, so that users adjust various settings of the NC earphone device 1, for example the micro-computers 10*l* and 10*r*, where the cord housing unit 4 is fitted to the cradle 30.

As an exemplary setting, there may be a customizable filter characteristic setting of the NC filter or an optimal gain setting of the NC filter. A firmware updates for the micro-computers 10*l* and 10*r* or a setting of the frequency characteristic of the equalizer may be also adjusted.

4. Various Functions

Here, various functions of the Lch micro-computer 10*l* and the Rch micro-computer 10*r* in the NC earphone device 1 are described below as shown in FIG. 7. In addition, FIG. 7 shows a block diagram for each function, the each function achieved by software processing of the Lch micro-computer 10*l* and the Rch micro-computer 10*r*. Regarding various functions achieved by software processing, hardware such as function units Fn configured to process the various functions is described below.

As illustrated in FIG. 7, the Lch micro-computer 10*l* includes a noise cancelling processing unit Fn1, an NC mode determination processing unit Fn2, a battery level detection unit Fn3, a charging control unit Fn4, and an external input setting processing unit Fn5. In addition, an NC mode synchronization control unit Fn7 and an after-level-check simultaneous ON control unit Fn10 are described later.

The noise cancelling processing unit Fn1 is described as illustrated in FIG. 4. The noise cancelling processing unit Fn1 generates the noise cancelling signal based on the recording signal from the microphone 11*l* and the Lch signal input from the plug unit 2, and drives the driver unit 12*l* based on the noise cancelling signal.

The NC mode determination processing unit Fn2 determines an appropriate NC mode depending on a condition of external noises. For example, in the embodiment, NC modes as NC filter characteristics may be predetermined as A mode (airplane), B mode (bus or train), or C mode (office) such that the NC mode determination processing unit Fn2 determines an appropriate mode among the NC modes according the condition of external noises based on the recording signal from the microphone 11*l*.

In addition, the battery level detection unit Fn 3 detects a remaining amount of the battery 13*l*. In addition, as described in FIG. 4, the charging control unit Fn4 controls a charging operation of the charging unit 4 for the battery 13*l* based on a determination result of whether the direct current for charging by the Lch wiring is supplied or not.

The external input setting processing unit Fn5 receives an input of settings from the external device connected to the communication terminals T and processes settings corresponding to the input. For example, when a filter coefficient of the NC filter is input as a setting value from the external device connected to the communication terminals T, a processing of setting the filter coefficient is executed On the other hand, the Rch micro-computer 10*r* includes four function units Fn among the noise cancelling processing unit Fn1 to the external input setting processing unit Fn5 of the Lch micro-computer 10*l* excluding the NC mode determination processing unit Fn2. Here, the same reference numerals of the each function unit Fn with respect to the Lch micro-computer 10*l* and the Rch micro-computer 10*r* are represented, the function units Fn of the Rch micro-computer 10*r* are described in the same way as the Lch micro-computer 10*l* except the sign of L or R, so that detailed descriptions are omitted.

In addition, the Rch micro-computer 10*r* includes an indicator display control unit Fn6 regarding the LED 15 in the housing 3Rh, as well as the four function units Fn1, Fn2, Fn3, and Fn4. The indicator display control function unit Fn6 verifies that the Rch micro-computer 10*r* has a control function of driving the emission of the LED 15.

The NC mode synchronization control unit Fn7, the error detection control unit Fn8, the simultaneous LR OFF control unit Fn9, and the after-level-check simultaneous ON control unit Fn10 in the Lch micro-computer 10*l* are described below. Here, regarding the processing of the NC mode synchronization control unit Fn7 and the after-level-check simultaneous ON control unit Fn10, the Lch micro-computer 10*l* of the Lch and Rch micro-computers 10*l* and 10*r* acts as a master computer.

First, the NC mode synchronization control unit Fn7 executes a process for synchronizing on the NC mode of the Lch and Rch output units 3L and 3R. In other words, the same NC mode determined by the NC mode determination processing unit Fn2 are set in both the Lch and Rch output units 3L and 3R.

Here, when the NC modes of the Lch and Rch output units 3L and 3R are different from each other, users become uncomfortable on the hearing. Accordingly, the NC mode synchronization control unit Fn7 controls that switching timings of the NC modes are synchronized with the output units 3L and 3R in order to switch the NC modes simultaneously.

The error detection control unit Fn8 detects errors of the Rch micro-computer 10*r* and performs a process corresponding to the errors. For example, in the embodiment, when a state that an operation of the Rch micro-computer 10*r* has stopped due to any errors, in order words an OFF state of the NC processing, is detected, the Lch micro-computer 10*l* is shut down or is turned off. In the embodiment, the determination of whether the Rch micro-computer 10*r* has been stopped or not is performed sequentially when communicating regularly with the Rch micro-computer 10*l*.

By the processing of the error detection control unit Fn8 like this, a situation that operating states become incoherent in the left and right of the NC earphone device 1 may be avoided effectively. For example, discomfort of users due to differences in hearing between the left and right of the NC earphone device 1 when only the Lch micro-computer is turned on may be avoided effectively. In addition, it is noted that when the micro-computers 10*l* and 10*r* is turned off, only the noise cancelling function is turned off but the sound output itself based on sound signals is continued.

In addition, the simultaneous LR OFF control unit Fn9 is configured to turn off both channels simultaneously when a remaining battery level of any one channel of the both channels is insufficient or less than a predetermined level, even if there is a sufficient remaining amount of the other channel. Accordingly, this configuration may avoid discomfort of users better than a configuration that the left and right of the NC earphone device 1 operate incoherently.

In addition, the after-level-check simultaneous ON control unit Fn10 checks remaining battery levels of the batteries of the left and right channels in response to a power-on instruction from users by the control button 4A, and controls to operate the left and right channels simultaneously only when remaining battery levels of the both channels are sufficient or more than a predetermined level.

Here, when an operation is attempted in case that a remaining battery level of any one channel is insufficient, any one channel may be operated but the other channel may be not operated. Accordingly, discomfort of users may occur due to differences in hearing between the left and right channels. However, the discomfort of users may be avoided effectively when operations of both channels are attempted in case that the remaining battery levels of both channels are sufficient.

In addition, the Rch micro-computer 10*r* includes the remaining level display control unit Fn11. In the embodiment, regarding the processing of the remaining level display control unit Fn11, the Rch micro-computer 10*r* acts as a master computer.

The remaining level display control unit Fn11 is configured to display a remaining battery level of any one channel having a smaller remaining battery level than the other channel by the LED 15. Here, in the embodiment, only one light emitting part of the LED15 may be provided, so that the LED 15 may display the smaller remaining battery level as well as the ON/OFF state. In the embodiment, these displays by the LED 15 may be configured based on a sequential timing. For example, the LED 15 may acts as an indicator for the display of the remaining battery level when the power is turned on, and then may acts as an indicator for the display of the ON/OFF state.

In this regard, the remaining level display control unit Fn11 is performed by the Rch micro-computer 10*r*, and checks the remaining battery levels of the right and left channels so that a light emission state of the LED 15 is controlled to display the smaller remaining battery level. Here, an example of the display technique of the remaining battery level may be the emission brightness, a blink rate, or the like. After the remaining battery level is displayed, it is controlled that the light emission state of the LED 15 displays the ON state Here, in the embodiment, the both channels are compulsively turned off by the simultaneous LR OFF control unit Fn9 when a remaining battery level of any one channel is insufficient even if a remaining battery level of the other channel is sufficient. In this regard, an appropriate remaining battery level is informed users of the remaining level display control unit Fn11.

In addition, in the embodiment, the LED 15 is used to display the remaining battery level when the power is turned on, so that the display of the ON/OFF state and the display of the remaining battery level are performed by one light emission part, or share the one light emission part.

5. Processing Procedure

As illustrated in flowcharts of FIG. 8 to FIG. 12, detailed processing procedures that are executed to achieve various functions of the NC mode synchronization control unit Fn7 to the remaining level display control unit Fn11 are described below. With respect to FIGS. 8 to 12, processes of "Lch" are executed by the Lch micro-computer 10*l*, and processes of "Rch" are executed by the Rch micro-computer 10*r*.

Figure 8:
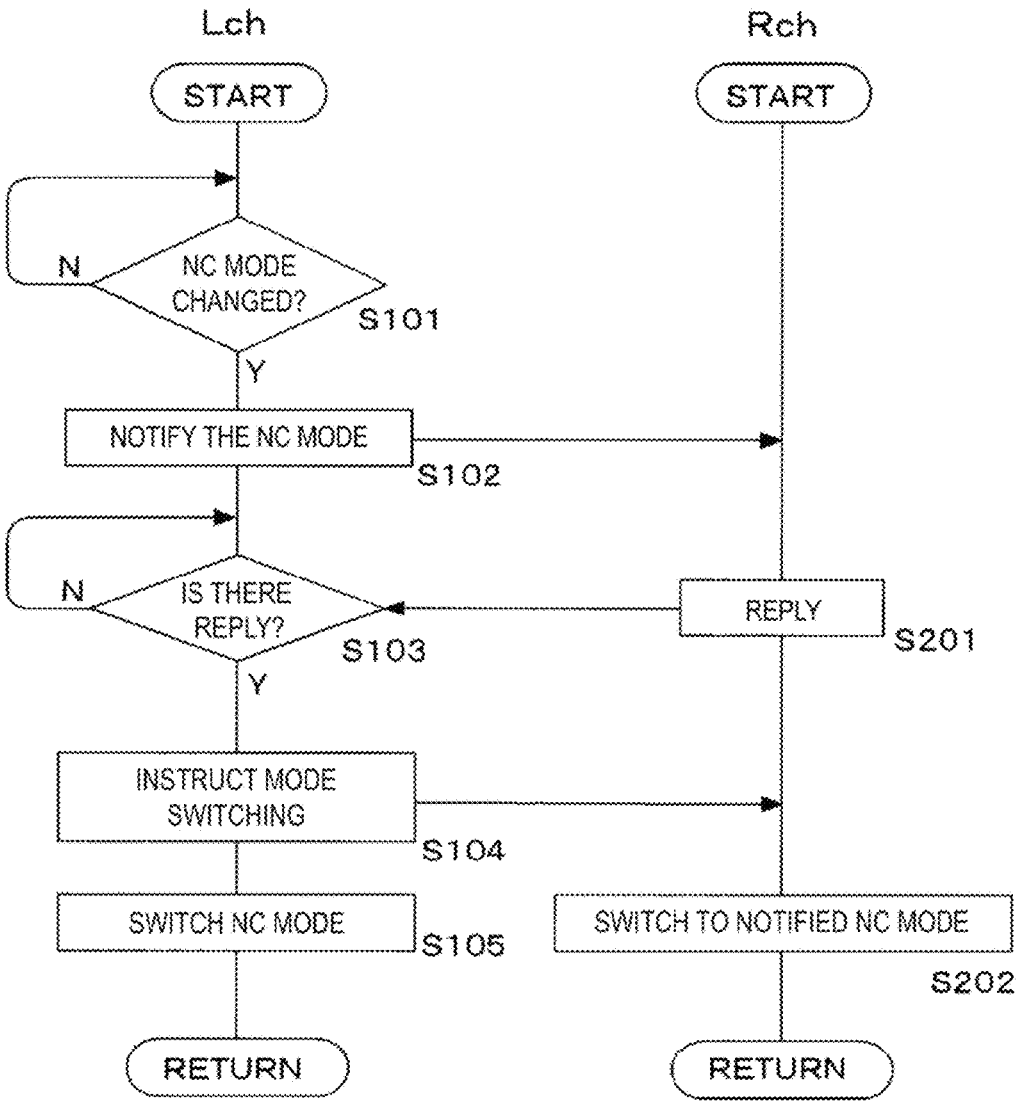
FIG. 8 is a flowchart illustrating a processing operation corresponding to NC mode synchronization control function unit.

FIG. 8 is a flowchart illustrating a processing operation corresponding to the NC mode synchronization control unit. First, in step S101 of "Lch", it is checked whether the NC mode is changed or not. In other words, it is waited until a new NC mode is determined by the NC mode determination processing unit Fn2.

When the NC mode is changed in step S101, the Rch is notified of the NC mode in step S102. In other words, the Rch is notified of the newly determined NC mode.

According to the notification of the NC mode, the Rch replies to the Lch in Step S201. For example, the reply is for the confirmation of the notification.

The Lch is waiting for a reply from the Rch in step S103. In step S103, when there is a reply from the Rch, an instruction on switching a mode is executed to the Rch in step S104. Then, the NC mode is switched in step S105. In other words, the NC mode is a newly determined NC mode, for example a filter characteristic of the NC filter.

In step S202, the Rch is executed to switch to the notified NC mode based on the instruction on switching a mode in step S104. In other words, switching to the NC mode notified from step S104 is executed.

As described above, the Lch waits for a reply from the Rch in response to the notification of the NC mode, and the Lch switches the NC mode of its own, so that the timing of switching the NC mode is synchronized.

Further, the synchronization of the NC modes in the left and right channels is performed in the timing of switching the NC mode, but also the Lch as a master notifies the Rch of the current NC mode on a regular basis so that the synchronization of the NC modes is performed.

Figure 9:
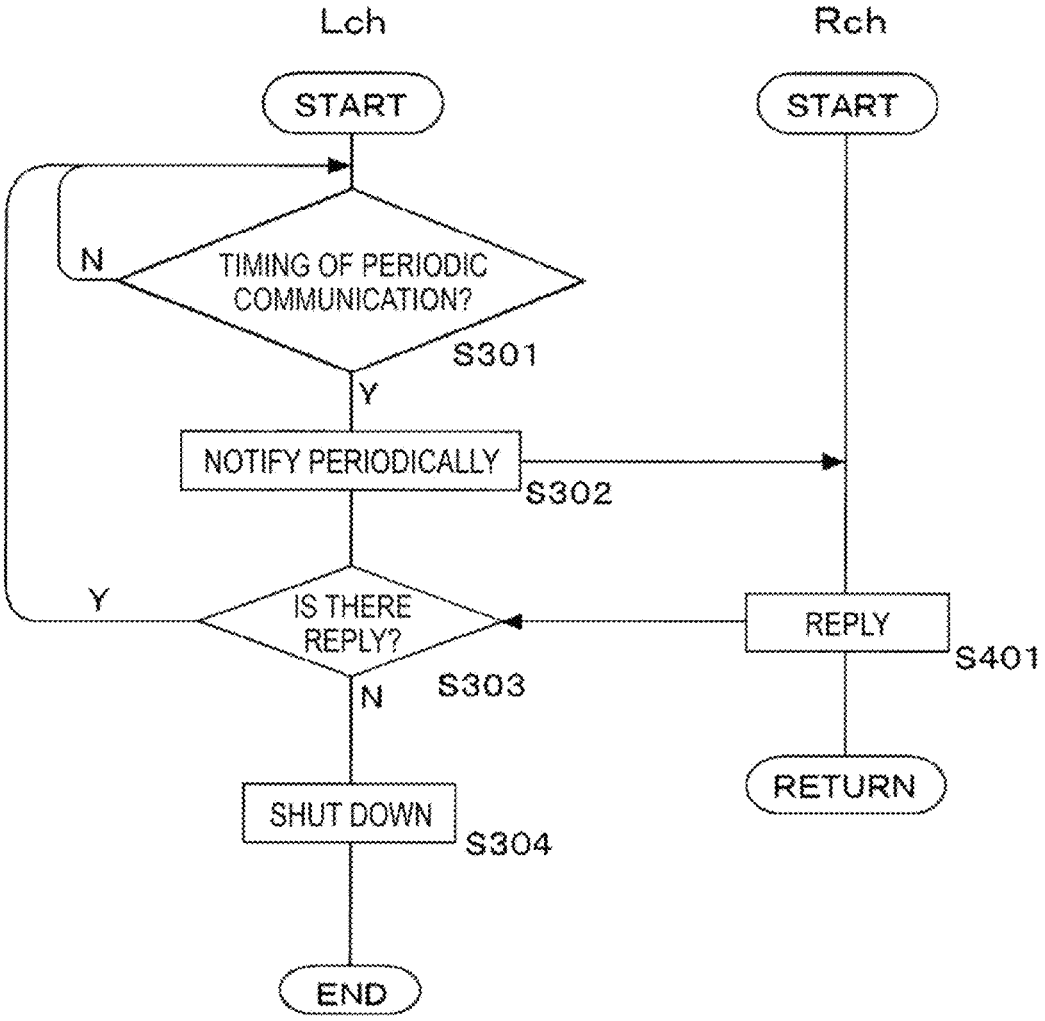
FIG. 9 is a flowchart illustrating a processing operation corresponding to the error detection control unit.

FIG. 9 is a flowchart illustrating a processing operation corresponding to the error detection control unit. As illustrated in FIG. 9, the Lch waits until there is a timing of the periodic communication in step S301. In other words, the Lch waits until the timing of the periodic communication with the Rch.

Then, when the timing of the periodic communication comes, a periodic notification is executed to the Rch in step S302. According to the periodic notification, the Rch replies to the Lch in step S401.

The Lch is determined whether there is the reply according to step S401 or not. In step S303, when there is the reply, the process returns to step S301. In other words, the process returns to step S301 when there is a reply thereby executing the loop process waiting until an operation stop state or an error state of the Rch is detected.

In step S303, a negative result is obtained when there is no reply from the Rch, shutting down is performed in step S304. Accordingly, the Lch may be configured to be an off-state when the Rch is the operation stop state.

Figure 10:
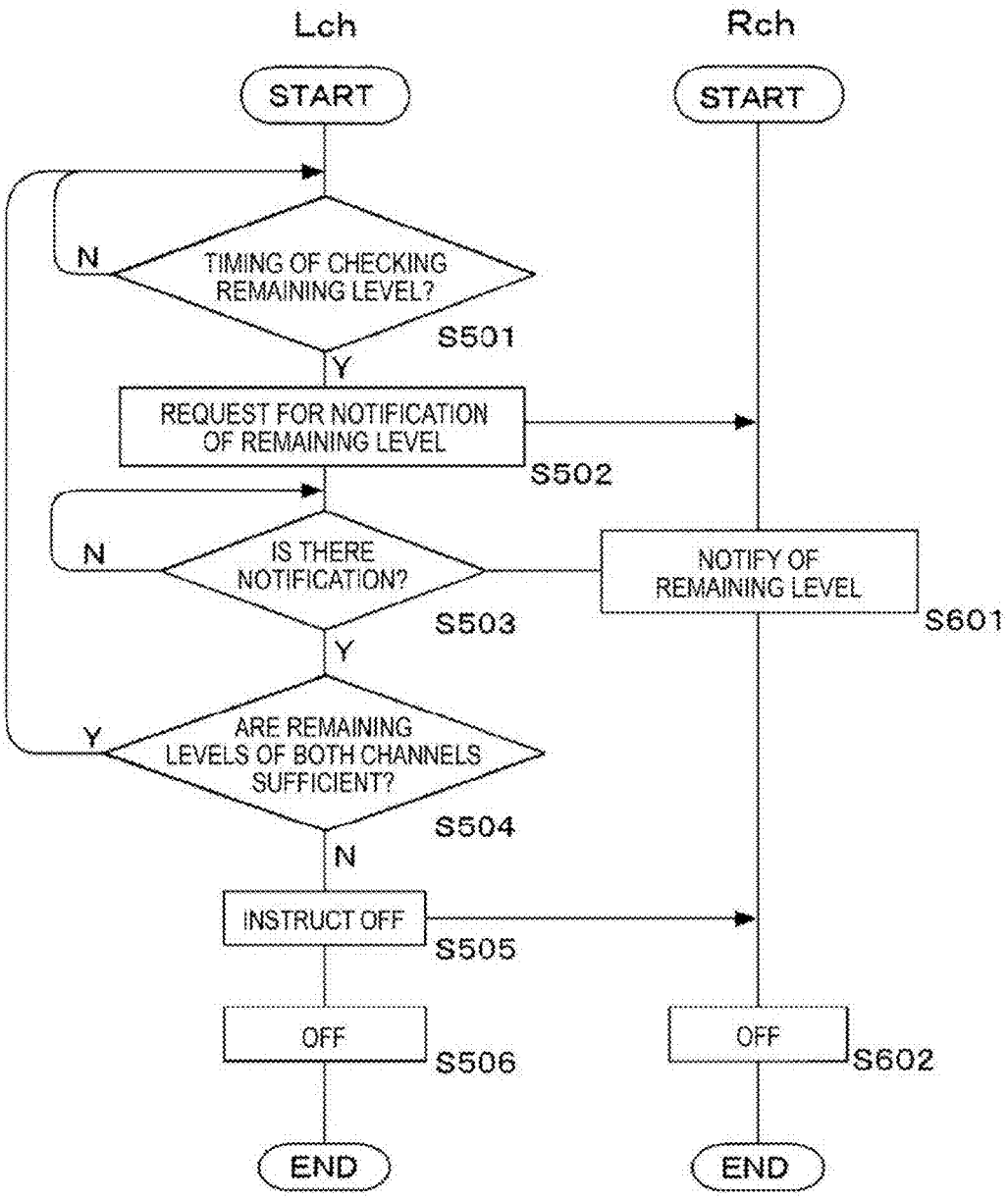
FIG. 10 is a flowchart illustrating a processing operation corresponding to the simultaneous LR OFF control unit.

FIG. 10 is a flowchart illustrating a processing operation corresponding to the simultaneous LR OFF control unit Fn9. As illustrated in FIG. 10, the Lch waits until there is a timing of checking a remaining level in step S501. Here, the timing of checking a remaining level refers a predetermined timing of checking a remaining battery level. For example, the timing may be a predetermined period of time.

When there is the timing of checking a remaining level, a request to notify the Rch of a remaining level is performed in step S502. According to the request for the notification of the remaining level, the Rch is configured to notify the Lch of the remaining level of the battery 13*r* in step S601.

The Lch is waiting for the notification of the remaining level according to step S601. Then, when there is the notification of the remaining level, it is determined whether remaining levels of the both batteries are sufficient or not in step S504. In other words, it is determined whether the remaining level of the battery 13*l* detected by the battery level detection unit Fn3 and the remaining level of the battery 13*r* notified from the Rch both are sufficient or more than a predetermined level or not.

When the remaining levels of the both batteries 13*l* and 13*r* are sufficient to obtain a positive result in step S504, the process returns to step S501. The process returns to step S501 when the positive result is obtained in step S504, thereby executing the loop process waiting until a negative result is obtained in step S504 or the remaining levels of the both batteries 13*l* and 13*r* are insufficient.

When the remaining levels of the both batteries 13*l* and 13*r* are insufficient to obtain a negative result in step S504, step S505 is processed to instruct on OFF or shutting down to the Rch. Then, the off state is performed in step S506.

According to the instruction on OFF in step S505, the Rch is the off state in step S602.

According to a series of processing as described above, when the remaining level of at least one battery is insufficient, both the Lch and the Rch is moved to the off-state at the same time.

Figure 11:
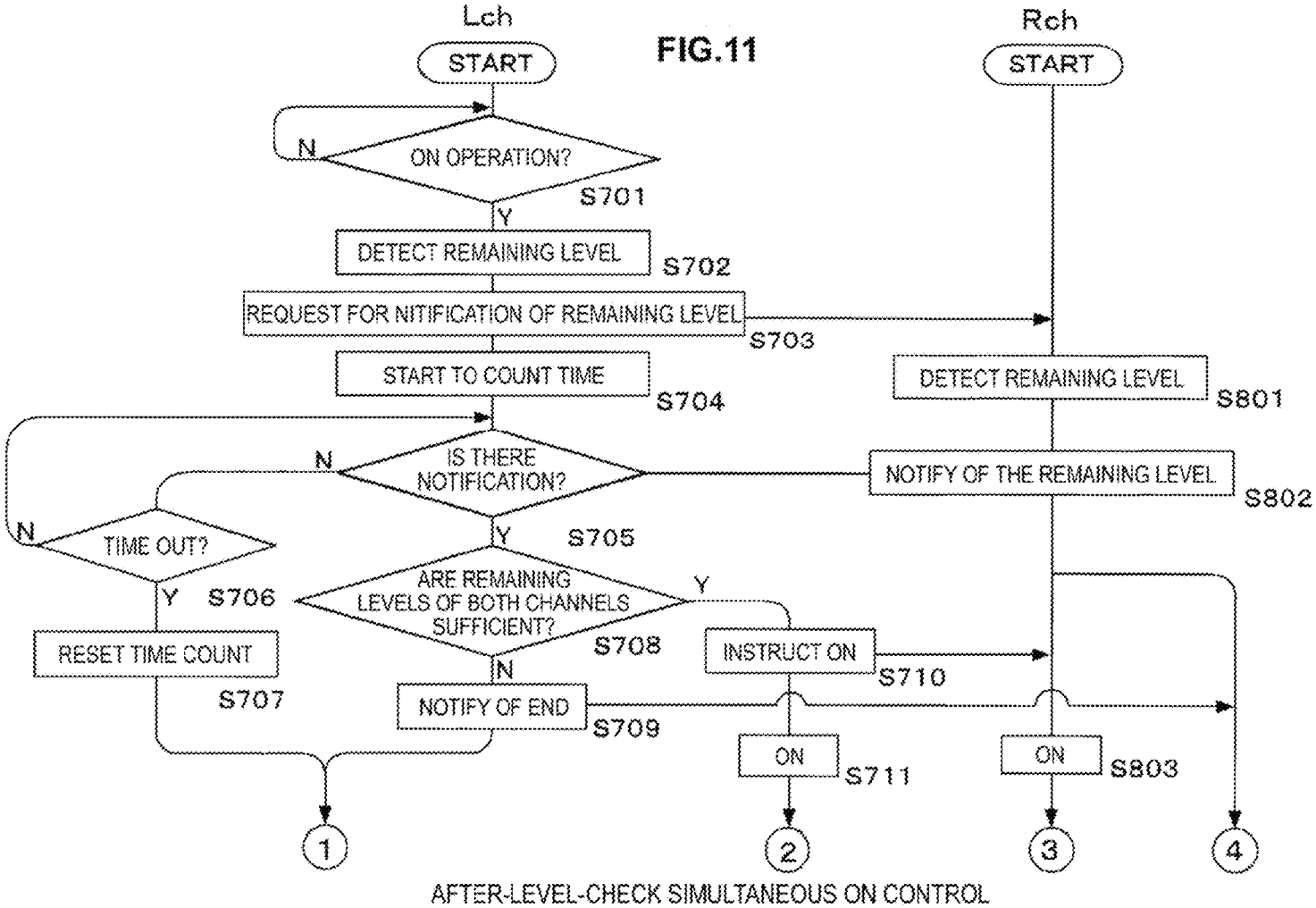
FIG. 11 is a flowchart illustrating a processing operation corresponding to the after-level-check simultaneous OFF control unit.
Figure 12:
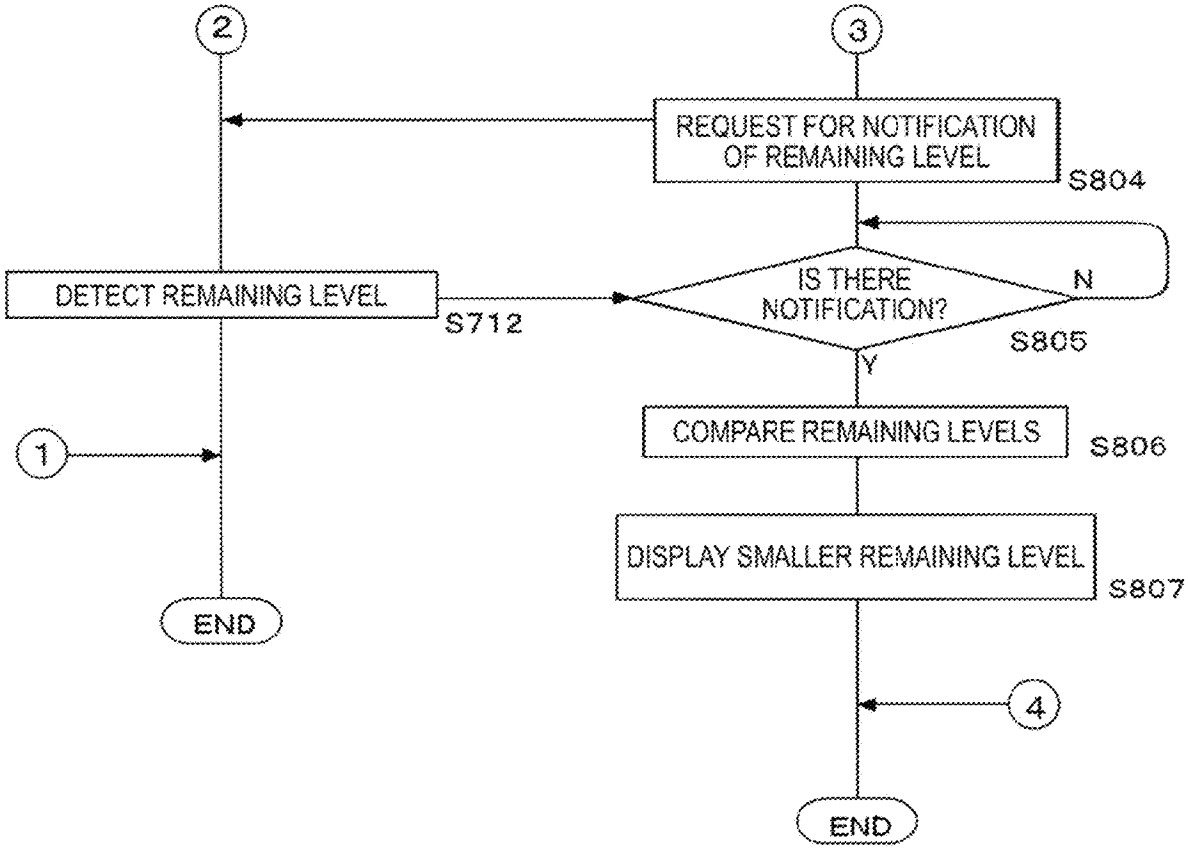
FIG. 12 is a flowchart illustrating a processing operation corresponding to the remaining level display control unit.
Figure 13:
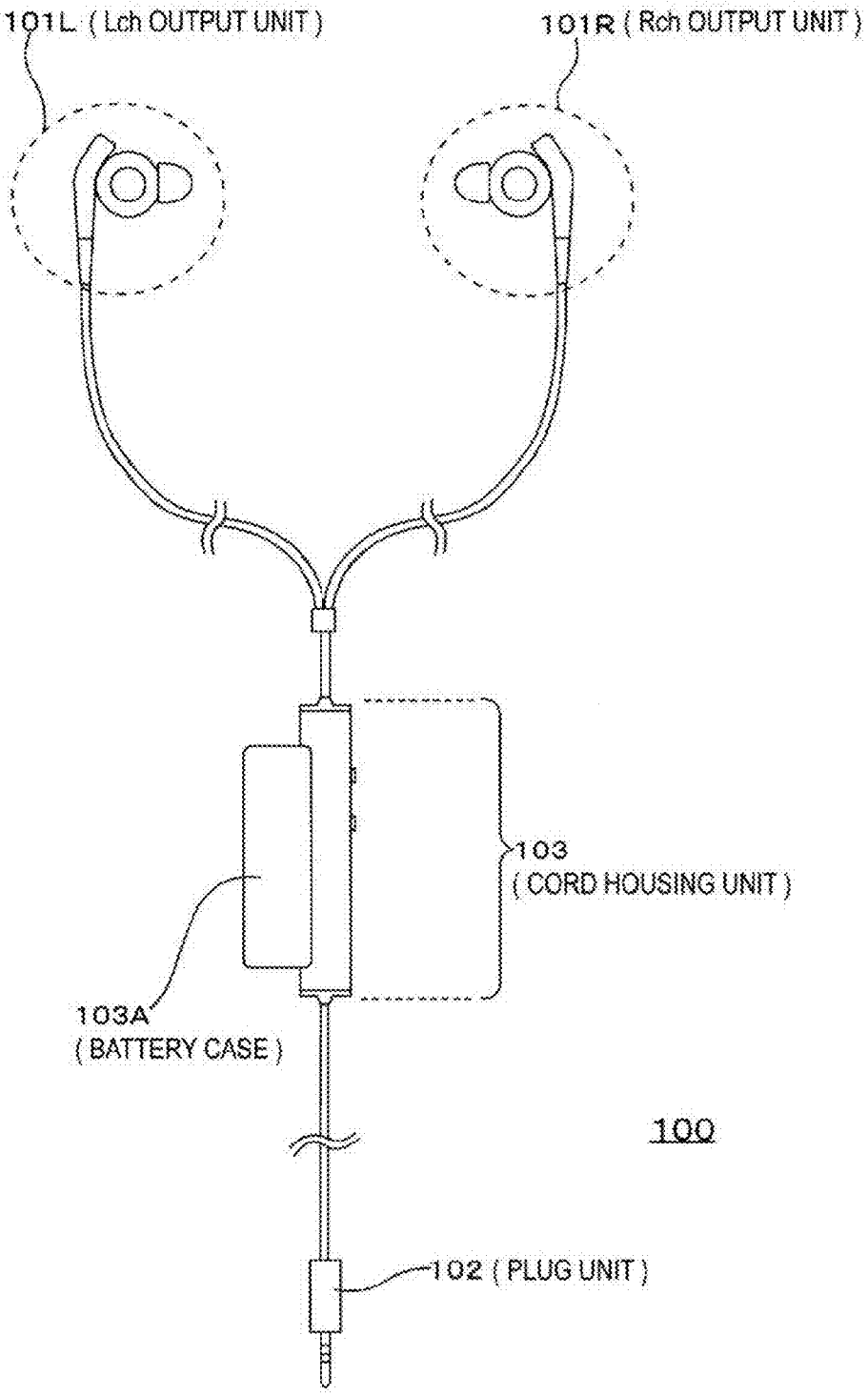
FIG. 13 is an appearance diagram of the NC earphone device in related art.

FIG. 11 is a flowchart illustrating a processing operation corresponding to the after-level-check simultaneous OFF control unit, and FIG. 12 is a flowchart illustrating a processing operation corresponding to the remaining level display control unit. As described above, in the embodiment, the processing according to the remaining level display control unit Fn11 is performed in response to turning on of the power. The processing according to FIG. 12 is a consecutive process of the processing of FIG. 11.

First, as illustrated in FIG. 11, the Lch waits until there is an ON operation in step S701. In other words, the Lch waits until a press of the control button 4A is detected. When there is the ON operation in step S701 on the operation, a remaining level of the battery 13*l* is detected as a remaining level detection processing of step S702, and then, the Lch is configured to request the notification of the remaining level to the Rch in step S703.

The Rch performs to detect a remaining level of the battery 13*r* as the remaining level detection processing of step S801 according to the request for the remaining level notification of step S703, and after that, the Rch notifies the remaining level detected in step S802.

Here, the Lch starts to count time in step S704 after requesting the notification of the remaining level in step S703. The time count is performed to count the elapsed time since making the request in step S703.

After starting the time count in step S704, the Lch waits until a condition of receiving the remaining level notification in step S705 or timing out in step S706 is satisfied. In other words, whether there is the remaining level notification or not is determined in step S705, and then, when a negative result is obtained due to no remaining level notification of the Rch, step S706 is going to determine whether time is out or not, or whether a time count value in step S704 reaches a predetermined value or not. Then, when a negative result is obtained due to no time-out in Step S706, the Lch goes back to step S705.

Here, when a positive result with a time-out is obtained in step S706, it may be supposed that the Rch is on any error state, for example, a state that the Rch is incapable of replying due to the depletion of the remaining level of battery 13*r*. When the positive result is obtained in step S706, step S707 goes to reset the time count, and then, the processing is finished. Accordingly, the Lch may not be solely operated when the Rch is supposed to be incapable of operating, so that operating states of the left and light are balanced.

When a positive result with the remaining level notification of the Rch is obtained in step S705, step S708 goes to determine whether remaining levels of both channels are sufficient. When a negative result is obtained by unsatisfying that the remaining levels of both channels are sufficient in step S708, step S709 goes to notify the Rch of the end notification, and then, the processing is finished.

The Rch finishes the processing according to the end notification from the Lch in step S709, as shown in FIGS. 11 and 12.

In this regard, when a remaining level of one battery of both channels is insufficient, it is supposed that both channels are not operated. Accordingly, discomfort of users may not occur by differences in hearing between the left and right channels, because it is avoided effectively that any one channel may be operated but the other channel may be not operated.

In addition, when a positive result with sufficient remaining levels of both channels is obtained in step S708, step S701 goes to perform the ON instruction or a start instruction, and then, the processing of switching to the ON state or starting is executed.

The Rch executes the processing of switching to the ON state in step S803 based on the ON instruction of step S710.

Accordingly, both channels are operated simultaneously only when remaining levels of both channels are sufficient.

Next, processes represented by FIG. 12 are described below. As illustrated in FIG. 12, the Rch starts by step S803, and then, the Rch requests the notification of the remaining level to the Lch in step S804.

The Lch is configured to notify the Rch of the remaining level according to the request for the notification of the remaining level from the Rch in step S712.

In step S805, the Rch waits for the notification of the remaining level from the Lch according to step S712. When there is a notification of the remaining level from the Lch, remaining levels of both channels are compared to each other in step S806, and then, the processing of displaying the smaller remaining level of both channels is executed in step S807. In other words, a light emitting operation of the LED 15 is controlled to obtain a light emission state representing the smaller remaining level of the batteries 13*l* and 13*r*.

In addition, regarding the control of displaying the remaining level, although the Lch notifies the Rch of the remaining level so that the Rch executes the control of displaying the smaller remaining level of both channel as described above, conversely the Lch may receives the remaining level from the Rch so that the Lch may select the smaller remaining level of both channel to transfer the result of the selection to the Rch, thereby controlling to display the remaining level.

6 Summary

As described above, in an embodiment, the batteries 13*l* and 13*r* to achieve the noise cancelling function are accommodated in the housings of the Lch and the Rch, so that the battery case 103A disposed in the cord housing unit 103 of the NC earphone device 100 in related art may not be used in the embodiment. Accordingly, the cord housing unit 4 is made significantly small and light, so that it may be prevented that the feeling of wearing of the Lch and Rch output units 3L and 3R is impaired by the weight of the cord housing unit 4.

In addition, according to the NC earphone device of the embodiment, since the Lch and Rch output units 3L and 3R are symmetrical bilaterally, the NC earphone device that weights of the left and right are balanced well and the feeling of wearing is excellent may be achieved.

In addition, when the Lch and Rch output units 3L and 3R are symmetrical bilaterally, empty spaces in the housings of the Lch and the Rch are the same as each other, so that acoustic characteristics of the Lch and the Rch are the same as each other, thereby achieving the natural feeling of hearing.

In addition, as the configuration that the batteries 13*l* and 13*r* are not accommodated in the cord housing unit 4, both the batteries 13*l* and 13*r* may be disposed in only one housing of both output units, but by this configuration, the housings of the Lch and the Rch are designed separately. However, when the Lch and Rch output units 3L and 3R are symmetrical bilaterally, the ease of design may significantly increase because one output unit may be designed by reversing the design of the other output unit regarding the design of the Lch and Rch output units 3L and 3R.

Further, in the embodiment, the circuit boards 21 or the micro-computers 10 are accommodated in the Lch and Rch output units 3L and 3R, respectively. Accordingly, the circuit boards 21 executing the noise cancelling processing are accommodated in the same housing as the microphones 11, so that a wiring distance between the microphones 11 and the circuit boards 21 may be significantly shorter than the configuration that a circuit board is disposed in the cord housing unit 103 as the earphone device in related art. As a result, the noise generated in the sound recording signal of the microphones 11 may be reduced. In addition, radiation arising from the wiring between the circuit boards 21 and the microphones 11 may be reduced.

In addition, in the earphone device in related art, when a circuit board is disposed in the cord housing unit, the power supply wiring to the cord housing unit from the battery accommodated in the output unit for the power supply to the circuit board is extended, and as such extent, the number of the wiring increases and a diameter of the cord also increases. The described above may be avoided effectively by accommodating the circuit boards 21 in the output units 3L and 3R according to the NC earphone device 1.

In addition, in the embodiment, the micro-computers 10 for the noise cancelling processing are accommodated in the housings of the output units 3L and 3R, respectively, and terminals T for the data communication between the micro-computers 10 are disposed in the cord housing unit 4. As such the configuration, the acoustic inspection is processed under the same condition as actual using when the communication terminals T are exposed in the acoustic inspection, because any part of the output units 3L and 3R is not dissembled. As a result, the setting value for the noise cancelling processing may be adjusted appropriately.

In addition, in the embodiment, the Lch micro-computer 10*l* and the Rch micro-computer 10*r* are configured to communicate data from each other, so that one channel may check an operation status of the other channel. Accordingly, it may be avoided effectively that the discomfort for the incongruity of the left and right channel operation occurs because the Lch and the Rch fail to check the operation status of each other, and therefore, operations of both channels are balanced. As a result, it may be avoided effectively that users feel the discomfort for the incongruity of the left and right channel operation.

7. Modified Example

An embodiment according to the technology has been described above, but the technology is not limited to the described embodiment. For example, as described above, the circuit boards 21 or the micro-computers 10 are accommodated in the Lch and Rch output units 3L and 3R, respectively. However, in an embodiment, the microphones, the driver units, and the batteries are accommodated in the Lch and Rch output units, and the circuit boards 21 may be disposed in the cord housing unit.

In addition, as described above, the technology is applied not only to the canal type earphone device, but also suitably to the ear hole insertion type earphone device that requests a comparatively small size of the sound output unit.

Additionally, the present technology may also be configured as below.

(1) An earphone device of an ear-hole insertion type having a noise cancelling function, the earphone device comprising:

a left channel housing unit that accommodates a left channel driver unit outputting a left channel sound; and a right channel housing unit that accommodates a right channel driver unit outputting a right channel sound, wherein a microphone for noise cancelling and a battery are accommodated in each of the left and right channel housing units.

(2) The earphone device of (1), wherein a substrate on which an noise cancelling processing unit configured to execute processing of achieving the noise cancelling function is mounted is accommodated in each of the left and right channel housing units.

(3) The earphone device of (1) or (2), wherein the earphone device is a canal type earphone device.

(4) The earphone device of (3), wherein each of the left channel driver unit and the right channel driver unit is a balanced amateur type driver unit.

(5) The earphone device of any one of (1) to (4), wherein the microphone is a MEMS microphone.

(6) The earphone device of any one of (1) to (5), wherein the battery is a button type secondary battery.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2011-189554 filed in the Japan Patent Office on Aug. 31, 2011, the entire content of which is hereby incorporated by reference.

What is claimed is:

1. An earphone device having a plurality of noise cancelling modes comprising:

a left channel housing unit that accommodates a left channel driver unit outputting a left channel sound;

a left microphone accommodated in the left channel housing unit;

a left battery accommodated in the left channel housing unit;

a left noise cancelling processing unit that generates a noise cancelling signal based on a sound signal recorded from the left microphone;

a right channel housing unit that accommodates a right channel driver unit outputting a right channel sound;

a right microphone accommodated in the right channel housing unit;

a right battery accommodated in the right channel housing unit; and a right noise cancelling processing unit that generates a noise cancelling signal based on a sound signal recorded from the right microphone, wherein both of the noise cancelling processing units communicate with each other to trigger selection of one out of a plurality of noise cancelling modes.

2. The earphone device of claim 1, wherein the left noise cancelling processing unit is accommodated in the left channel housing unit and the right noise cancelling processing unit is accommodated in the right channel housing unit.

3. The earphone device of claim 1, wherein the earphone device changes noise cancelling modes automatically depending on a current condition of external noise.

4. The earphone device of claim 1, wherein the one out of a plurality of noise cancelling modes is set after the right noise cancelling processing unit sends a right signal to the left noise cancelling processing unit.

5. The earphone device of claim 1, wherein the one out of a plurality of noise cancelling modes is set after the left noise cancelling processing unit sends a left signal to the right noise cancelling processing unit.

6. The earphone device of claim 1, wherein the one out of a plurality of noise cancelling modes is set after the right noise cancelling processing unit sends a right signal to the left noise cancelling processing unit and the left noise cancelling processing unit sends a left signal to the right noise cancelling processing unit.

7. The earphone device of claim 6, wherein the right signal triggers the left signal to be sent to the right noise cancelling processing unit.

8. The earphone device of claim 6, wherein the left signal triggers the right signal to be sent to the left noise cancelling processing unit.

* * * * *